US005662522A

United States Patent [19]

Waltz

[11] Patent Number: 5,662,522

[45] Date of Patent: Sep. 2, 1997

[54] EXHAUST VENT

[75] Inventor: Arthur L. Waltz, Ridgefield, Wash.

[73] Assignee: Noll Manufacturing Co., Fife, Wash.

[21] Appl. No.: 152,288

[22] Filed: Nov. 12, 1993

[51] Int. Cl.[6] ..... F23L 17/00

[52] U.S. Cl. ..... 454/359; 454/367

[58] Field of Search ..... 34/235; 454/5, 454/30, 31, 350, 351, 353, 359, 363, 366, 367, 368; 285/42, 43

[56] References Cited

U.S. PATENT DOCUMENTS

| | | | |
|---|---|---|---|
| D. 34,037 | 2/1901 | Reynolds . | |
| D. 193,642 | 9/1962 | Patterson . | |
| D. 254,804 | 4/1980 | Ballard | D23/153 |
| D. 257,282 | 10/1980 | Roberts | D23/153 |
| D. 257,283 | 10/1980 | Roberts | D23/153 |
| D. 259,208 | 5/1981 | McCullough | D23/153 |
| 2,552,966 | 5/1951 | Harp | 454/351 X |
| 2,741,972 | 4/1956 | Pryne | 454/363 X |
| 2,770,833 | 11/1956 | Prechsel | 454/359 X |
| 2,806,419 | 9/1957 | Artis . | |
| 2,985,091 | 5/1961 | Hatcher . | |
| 3,238,862 | 3/1966 | Smith et al. | 98/42 |
| 3,250,206 | 5/1966 | Strouth | 454/359 |
| 3,285,155 | 11/1966 | Maltenfort | 454/359 |
| 3,685,426 | 8/1972 | Rosa . | |
| 3,842,722 | 10/1974 | Miller | 454/359 |
| 3,886,852 | 6/1975 | Acosta . | |
| 3,895,568 | 7/1975 | Stone | 454/353 X |
| 4,010,578 | 3/1977 | Logsdon | 52/58 |
| 4,151,789 | 5/1979 | Grobard | 454/359 |
| 4,214,513 | 7/1980 | Ballard . | |
| 4,297,818 | 11/1981 | Anderson | 454/366 X |
| 4,461,066 | 7/1984 | Peterson | 29/455 R |
| 4,622,887 | 11/1986 | Peterson . | |
| 5,167,578 | 12/1992 | Legault | 454/350 |

*Primary Examiner*—Harold Joyce

*Attorney, Agent, or Firm*—Christensen, O'Connor, Johnson & Kindness PLLC

[57] ABSTRACT

A ventilator having a one-piece plastic base with integral tubular member having a through passageway for flow of an exhaust gas stream. The tubular member is preferably molded simultaneously with the base, rather than glued, so that the base and tubular member assembly comprise not only a sealed tubular member, but provide a single, seamless part. Thus, moist air cannot leak out of the air flow path between the interior and exterior of a wall or roof. The ventilator is also provided with a screen and a flapper type lid for the tubular member. The flapper lid seals the outer end of the tubular member against inflow of outside air at those times when there is no exhaust gas stream impinging against the flapper so as to keep the flapper in the open position. The ventilator may be provided in a variety of colors by pigmentation of the plastic to be molded into the ventilator.

28 Claims, 5 Drawing Sheets

EXHAUST VENT

TECHNICAL FIELD OF THE INVENTION

This invention relates to devices for the ventilation of building structures. More particularly, the present invention relates to novel ventilators for use in roof and wall exhaust service, particularly for use in residential and light commercial buildings.

BACKGROUND

In the construction of structures such as a house or a light commercial building, a number of areas require direct ventilation to the outside air. Rooms such as restrooms, bathrooms, and kitchens are often provided with ventilation exhaust fans which remove undesired vapors from the room for ejection to the outside. Also, clothes dryers normally generate an exhaust gas stream containing the moisture removed from clothing which is being dried; this moisture laden gas stream is preferably directed outdoors. Roof vents and wall vents have long been used for these purposes.

The roof and wall vent designs which are presently most commonly used in residential and light commercial construction basically utilize a two piece structural design. In that design, a vent is provided with a flat shoulder for sealing the vent to an external building structure. An internal adapter is affixed to the building interior and juxtaposed to the shoulder of the external portion of the vent, so that the opening in the external portion of the vent matches the opening of the adapter. Then, a duct or flex hose is provided from a fan or other exhaust device to connect to the interior side of the adaptor.

Unfortunately, all to often the just described two piece construction method results in undesirable vent operation. For example, a gap may be left between the adaptor and the vent which lets a portion of the exhaust gases escape into the wall space, or back into the interior of the building. Where such gases are humid, as in dryer or bathroom exhausts, condensation can take place within the wall space, with cumulative deleterious affects on the building structure. The moisture deposited in the wall is also generally attractive to damaging insects. Further, the gap between the vent and the adaptor may allow entry of such insects into the damp wall space. Moreover, the moisture may damage certain types of insulation, and which results in a reduction in the insulation efficiency, thus increasing heat transfer outward from (or inward to) the building. That in turn increases energy costs for heating and cooling.

Generally, there have been developed a wide variety of devices which may be utilized to provide vents in roofs and walls. U.S. Pat. Ser. No. Des. 34,037, issued Feb. 5, 1901 to Reynolds for VENTILATOR superficially resembles our vent upon first inspection, but on closer scrutiny reveals that only a short downwardly projecting pipe adaptor section is provided. Further, the cap is of multi-piece riveted (evidently metal) construction, and does not have a shoulder base, so the pipe adaptor would have to be used to extend the vent above an exterior surface. U.S. Pat. No. 4,214,513 issued Jul. 29, 1980 to Ballard et al. for ONE-PIECE ROOF VENT DEVICE AND METHODS OF CONSTRUCTION AND UTILIZING SAME, and U.S. Pat. No. Des. 254,804 issued Apr. 22, 1980 to Ballard et al. for ROOF VENT, both reveal a vent with a flat base portion. The base portion and the outwardly protruding vent and cap portion are manufactured from one piece of aluminum; however, there is no downwardly extending tubular portion for connection to interior ductwork. And, although there are a wide variety of other types of vents, in so far as we are aware, most are multi-piece vents with various problems inherent in the joints provided, and therefore to some degree thus suffer from leakage and may result to some extent in the above described problems during use of such vents.

The problems and disadvantages with respect to the prior art vents described above are virtually eliminated by the present invention.

SUMMARY

We have now invented, and disclose herein, a novel molded plastic ventilator which includes a sealed tubular member to transport airflow through a structure without leakage. It is like those vents heretofore used at its exterior portions, in that it provides a flat outwardly extending base and an outwardly projecting cap portion. However, our novel molded plastic ventilator varies from those prior art vents in that (1) the tubular member provided for flow of gases to the outside and (2) the base for mounting the vent, are combined into a single one-piece base of molded, preferably plastic construction. Also, it is preferable that the tubular member is molded simultaneously with the base, rather than glued, so that the base and tubular member assembly comprise not only a sealed tubular member, but provide a single, seamless part. Thus, moist air cannot leak out of the air flow path between the interior and exterior of a wall or roof.

This design also eliminates the need for separately mounting an interior vent adaptor and an exterior roof vent, and therefore eliminates the installation labor required to install a completed ventilator from two complementary parts. Further, the sealed tubular ventilator may be made from any convenient moldable plastic, such as polystyrene, polyethlyene, or the like, and eliminates the need to build the air flow path in such devices from both metal or multiple plastic parts.

In addition to the molded one-piece base, our ventilator generally is also provided with a screen and a flapper type lid for the tubular member. The flapper lid seals the outer end of the tubular member against inflow of outside air at those times when there is no exhaust gas stream impinging against the flapper so as to keep the flapper in the open position.

Moreover, my one-piece molded plastic roof and wall vent is simple, relatively inexpensive, and easy to manufacture; it provides superior non-leaking performance during use for handling exhaust gases, and is otherwise superior to the heretofore known ventilation devices of which we are aware.

In general, ventilators employing the principles of our present invention include a continuous one-piece molded tubular member having a through passageway, with the tubular member having a bottom and a top and an exterior wall portion.

Preferably, the tubular member is of annular cross-section and is molded in one-piece perpendicular to and with a flat outwardly extending base member.

More preferably, the molded tubular member is of plastic, corrosion resistant construction.

For strength, and to provide a mounting member for a hood portion, a short, outwardly projecting ringlike band or side is provided spaced about the center of the base, a outward face portion is then provided substantially coplanar to the base portion and extending from the band toward the center to and joining with the tubular member. An exterior flange portion of the tubular member extends outwardly from the outward face portion. The interior wall of the tubular member extends sealingly and preferably seamlessly from the outer edge of the exterior flange portion of the tubular member to the inner edge of the interior portion of the tubular member, so that fluid leaks through the wall of the tubular member are impossible.

Additionally, within the hood portion of the vent, a cover means for the tubular portion may also be affixed; the cover means is displaceable to an open position by outward fluid flow and returns to a closed position upon fluid flow termination. Preferably, the cover means is of the flapper valve type, and comprises a substantially planar element with a pivot portion for pivoting outwardly in response to fluid pressure when the vent is experiencing exhaust flow. The flapper valve is mounted so that in the absence of pressure from fluid flow, the cover means substantially mates with the exterior flange portion of the tubular member to form a barrier against inward flow of gases. The cover means is operatively connected with, or may integrally include, a hinge means for permitting the cover to move from the closed position (substantially preventing air passage therethrough) to an open position (allowing air passage therethrough). There are substantially upwardly directed hinge supports projecting from the rearward portion of the outward face portion of the vent. Within the hood, there are substantially downwardly directly hinge retainers, juxtaposed opposite the locations of the hinge supports and acting in cooperation therewith to securely locate hinge means in an operative position.

The hood portion also has a forwardly projecting roof portion. Side shields extend from the sides of the hood forward and upward to join with the roof portion.

The hood portion also defines an exhaust opening. The forward interior periphery of the hood portion and the forward portion of the outward face portion each include a pair of screen retainer ridges, which are used to retain a screen of preselected size. The screen or other porous member is configured to allow the outward passage of gas therethrough but to preclude the inward passage of solids above a preselected screen mesh size.

When used in construction, the molded plastic seamless roof vent is is securely positioned on an exterior surface (roof or wall) of a building structure. The tubular member extends inwardly through a precut aperture of a size and shape complementary to the size and shape of the tubular member, for the desired distance or length X of a tubular member to effectively completely penetrate the selected roof or wall structure, with sufficient overlap to allow the tubular member sufficient free exterior wall space to receive and be sealing secured to a duct through which the exhaust fluid is brought to the vent. The connecting duct work is normally affixed to and sealed to the tubular member via duct tape or clamp or the like (or both) to provide a leak tight joint with the tubular member.

The novel, seamless one-piece molded plastic tubular member and base for a roof or wall exhaust ventilator described herein represents a significant improvement in the art. Although in the past there have been a molded plastic ventilators prepared from two or more individual plastic sections that are joined by fasteners or otherwise into an single unit, in so far as we are aware, it has heretofore not been proposed to provide an integral, sealed tubular member and base portion. Our one-piece molded plastic base with integral tubular member design eliminates seams or joints in the ventilator air flow passageways, thus eliminating the possibility of leakage of damp air through such seams. Also the one-piece molded construction of our ventilator eliminates the necessity for fasteners to join vent sections, thus reducing field installation costs. Moreover, our novel vent with a one-piece molded base having an integral through passageway assures that exhausted gases are vented wholly outside of the building.

OBJECTS, ADVANTAGES AND FEATURES

From the foregoing, it will be evident to the reader that the primary object of the present invention resides in the provision of a novel seamless roof ventilator base with integral sealed tubular member.

It is a further object of the present invention to provide a roof and wall ventilator:

which does not allow air flow leaks through joints or cracks when exhaust air is sent therethrough;

which assures that exhausted gases solely and completely reach the building exterior, without loss or leakage;

which minimizes field assembly labor;

which avoids the use of adaptor plates and fasteners for assembly.

Other also important but more specific objects of the invention reside in the provision of a molded, one-piece roof vent base with integral tubular member in accord with the preceding objects:

which allow one to preselect the size of the ventilator so a unit of appropriate size and tubular length can be mounted on a roof or wall of preselected thickness to achieve the proper fit;

which is capable of resisting deterioration by corrosion or erosion during many years of use, particularly with moist or corrosive airstreams, due to use of plastic construction;

which is rugged and durable;

which, in conjunction with additional movable cover means or flapper valves, automatically open and close to facilitate the correct ventilation flow;

which is easy to install by unskilled or semi-skilled labor;

which, in conjunction with the preceding objects, is so designed that the ventilation apparatus provides a superior device for providing air flow from an interior space to the outside air.

One of primary advantages of the present invention is that less manual labor is needed in the installation of the vent. With the heretofore known roof and wall vent units, it was necessary to manufacture the two pieces and then separately affix the two pieces at the correct locations to form a finished venting system. That required extra handling of the pieces, and created the possibility of installation errors. Also, in order to create a seal between a vent base and a vent adaptor, it has normally been necessary to use roofing tar or other sealant, the application or which is messy, time consuming, and at additional expense. The net result of the present invention is that there is (a) an improved vent performance, i.e., leakless technology is provided, and (b) a savings in installation labor is provided. Overall, then, a better product is provided at reduced total cost.

While the present invention is generally described with reference to and as an improvement upon earlier multi-piece plastic roof vents, it should be understood that the one-piece base with integral tubular member vent design may be suitable for utilization in the fabrication of a variety of designs for various types of vent service, such as dryer exhaust vents, bathroom exhaust vents, or kitchen vents.

Other important objects, features and additional advantages of the invention will be apparent to the reader from the foregoing and the appended claims and as the ensuing detailed description and discussion of the invention proceeds in conjunction with the accompanying drawing.

BRIEF DESCRIPTION OF THE DRAWING

The invention may be better understood by reference to the accompanying drawing, wherein.

DESCRIPTION

Figure 1:
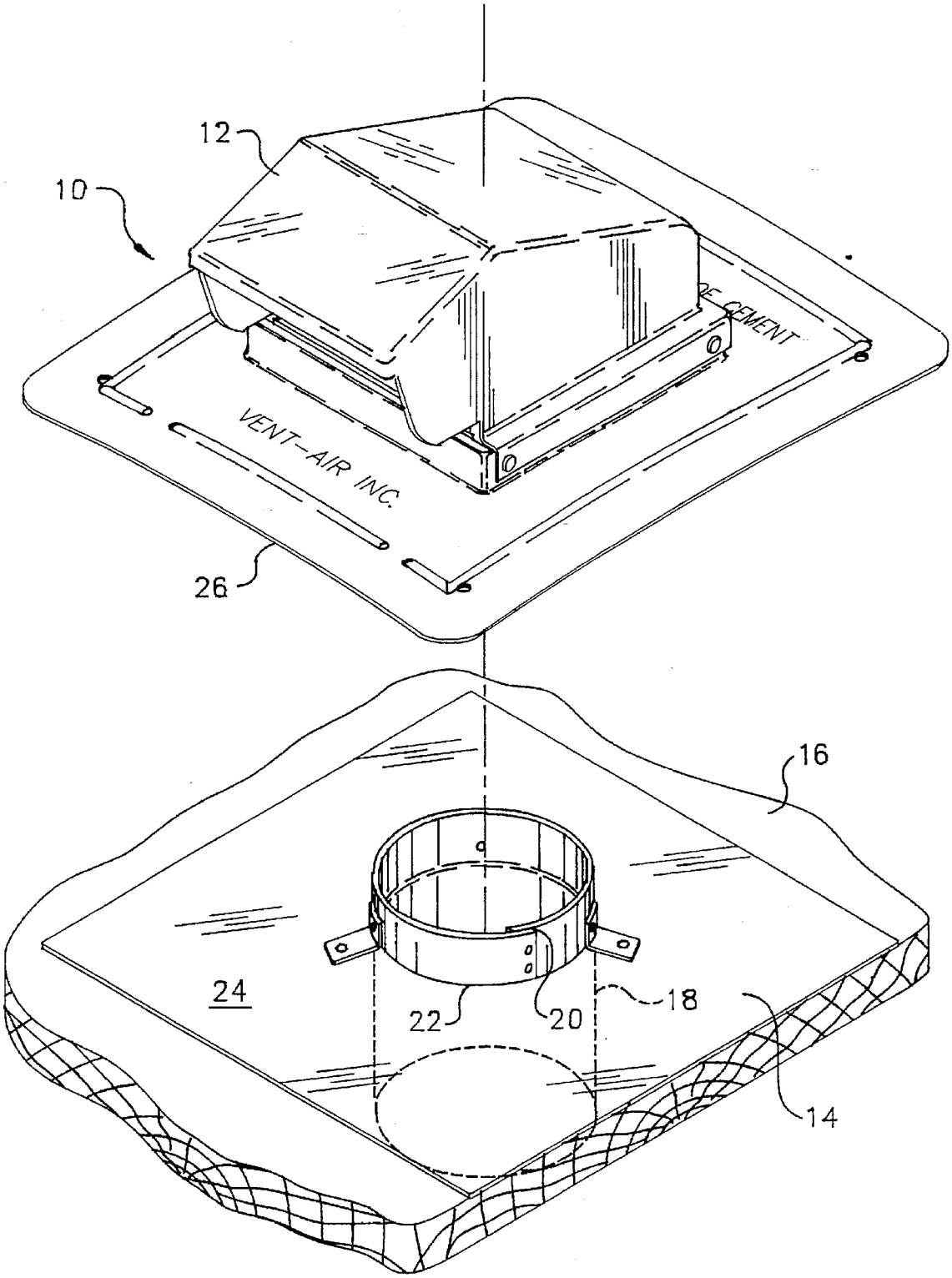
FIG. 1 PRIOR ART
FIG. 1 is a partially broken away front perspective view of a prior art two piece roof vent with having a plastic exterior portion and an interior adaptor plate.

Attention is directed to FIG. 1, where a prior art exhaust vent 10 is shown. The prior art vent 10 is a a "two-piece" construction, in that an upper portion 12 is provided and an adaptor portion 14 is provided. The adaptor portion 14 is set upon the roof or wall deck 16, with a tubular member 18 extending through the deck 16. The tubular member 18 is often rolled from sheet metal, resulting in a lengthwise joint 20. Also, where the tubular member 18 is affixed to adaptor portion 14, a joint 22 occurs, which is often left unsealed. Thus, it can be appreciated that such two-piece installations depend upon a good fit and seal (a) along lengthwise joint 20, (b) between the tubular member 18 and the adaptor plate 14 at joint 22, and (c) between the upper surface 24 of adaptor plate 14 and the lower surface 26 of upper vent portion 12. As generally set forth herein above, such prior art ventilators as shown in this FIG. 1 provide the potential for leakage of moisture laden air into adjacent structure, to reduce the effectiveness of adjoining insulation and creating an attractive nuisance for potentially damaging insects.

Figure 2:
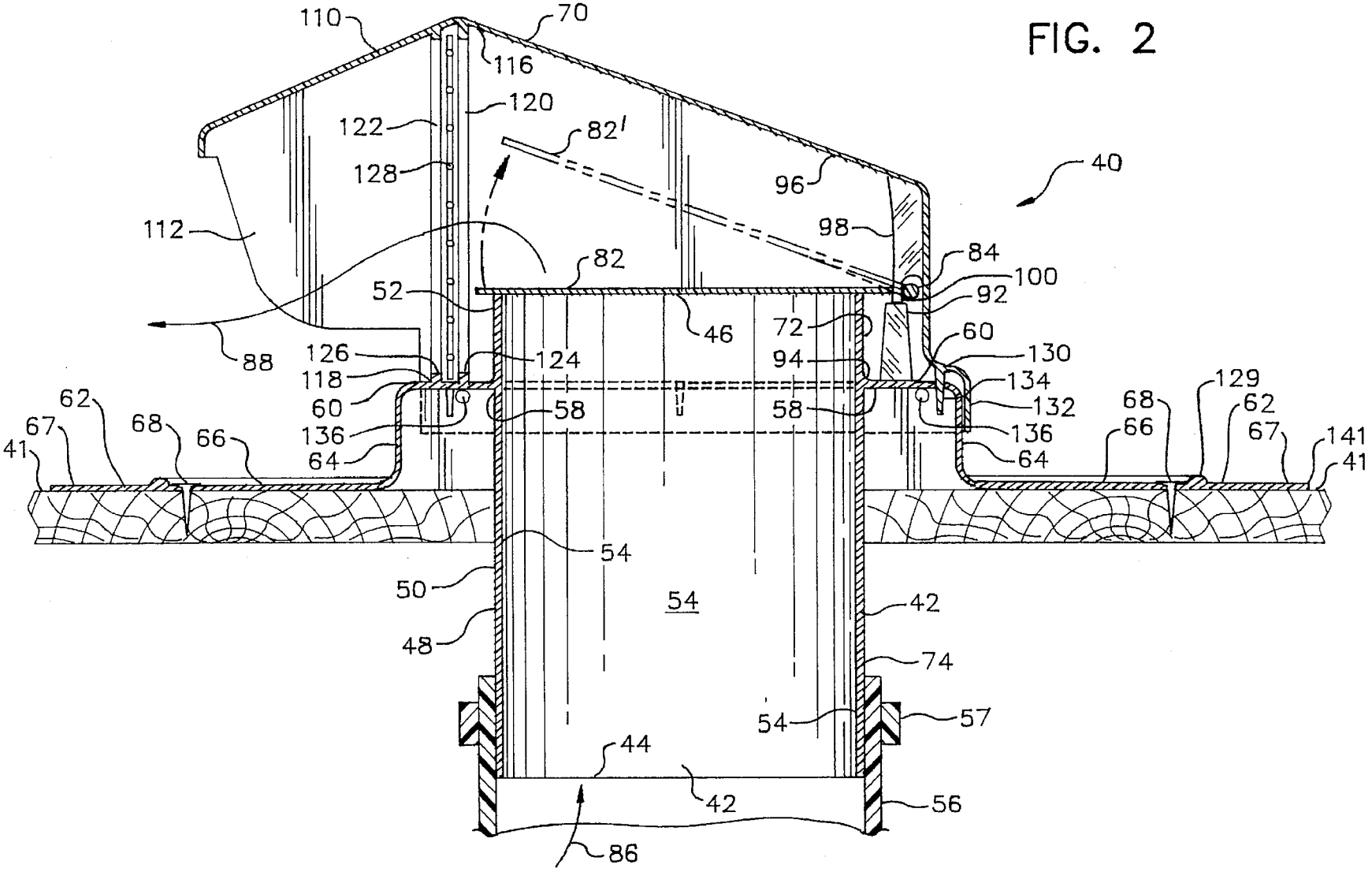
FIG. 2 is a vertical cross-sectional view of the exhaust vent of the present invention.

Attention is now directed to FIG. 2, wherein a ventilator 40 with a one-piece type base having an integral tubular member is shown installed on a roof deck 41. In general, ventilators employing the principles of the present invention include a continuous one-piece molded plastic tubular member 42 having a through passageway, with the tubular member having a bottom 44 and a top 46, an exterior wall portion 48 with lower 50 and upper 52 sections, and an interior wall portion 54 which defines the aforementioned through passageway.

Preferably, for ease in attachment of a duct member 56 (normally by clamp means 57 or the like) to the tubular member 42, the tubular member is of annular cross-section and is molded in one-piece so that the lower 50 and upper 52 exterior wall sections join at an attachment point 58 to the outward face portion 60 of an outwardly extending base member 62. Preferably, the outward face portion 60 extends outward from the tubular member 42 to a downwardly extending ring band portion 64, which then extends downward to and is integrally molded with the interior portion 66 of base 62. Both the interior portion 66 and the periphery 67 of base member 62 are secured flat against roof deck 41 by fasteners such as nails 68.

For strength, and to provide a mounting member for separately provided a hood portion 70, the short, outwardly projecting outward face portion 60 and the ring band or side portion 64 is provided generally centrally located in the base 62. The outward face portion 60 is preferably provided substantially coplanar to the base 62, and extending from the ring band 64 toward the center to and attaching at attachment point 58 with the tubular member 42. An exterior flange portion 72 of the tubular member 42 extends outwardly from the outward face portion 60. The interior wall 54 of the tubular member 42 extends sealingly, and preferably seamlessly, from the top 46 of the tubular member 42 which forms the outer edge of the exterior flange portion 72 to the bottom 44 of the interior flange 74 of tubular member 42, so that fluid leaks from the tubular member 42 are impossible.

Additionally, within the hood portion 70 of the vent 40, a preferably flapper valve type cover means 82 may also be affixed. The flapper type cover means 82 is a substantially planar element with a hinge means or pivot portion 84 for pivoting outwardly to position 82' in response to fluid pressure when the vent 40 is experiencing flow of exhaust gases as indicated by reference arrows 86 and 88. The flapper valve 82 is mounted so that in the absence of pressure from exhaust gas 88 flow, the flapper valve 82 substantially mates with the upper end 46 of the exterior flange portion 72 of tubular member 42, to form a barrier against inward flow of gases. The flapper valve or cover means 82 is operatively connected with, or may integrally include the hinge means 84, for permitting the valve 82 to move from the closed position indicated by reference numeral 82 (substantially preventing air passage therethrough) to an open position indicated by reference numeral 82' (allowing air passage therethrough). Also, there are substantially upwardly directed hinge supports 92 projecting from the rearward portion 94 of the outward face portion 60. Within the rear 96 of hood 70, there are substantially downwardly directly hinge retainers 98, with retainer pins 100 (aligned as indicated by lines of position A and B in FIG. 3), juxtaposed opposite the locations of the hinge supports 92 and acting in cooperation therewith to securely locate hinge means 84 in an operative position.

The hood portion 70 also has a forwardly projecting roof portion 110. Side shields 112 extend from the sides of the hood forward and upward to join with the roof portion 110.

The hood portion 70 also defines an exhaust opening 114. The forward interior periphery 116 of the hood portion 70 and the forward portion 118 of the outward face portion 60 each include a pair of screen retainer ridges, designated by reference numerals 120 and 122 in the forward portion 118 of the hood 70 and by reference numerals 124 and 126 on the outward face portion 60. These retainer ridges 120, 122, 124, and 126 are used to retain a porous member or screen 128 of preselected size. The screen 128 is configured to allow the outward passage of exhaust gases therethrough (as indicated by reference arrow 88) but to preclude the inward passage of solids above a preselected screen mesh size.

Also visible in this FIG. 2 is the use of a moisture barrier 129. The moisture barrier 129 is located between the interior portion 66 and the peripheral portion 67 of the base 62 for at least a portion of the perimeter the interior portion 66. The moisture barrier has a vertical dimension, preferably about 0.125 inches or more, whereby the vertical dimension results in an upward gradient toward the periphery 67 of the vent base 62 and against which water cannot flow by gravity. This moisture barrier 129 thus protects against outward flow of moisture which, if not arrested, would tend to flow toward and ultimately under adjacent roofing materials.

Figure 3:
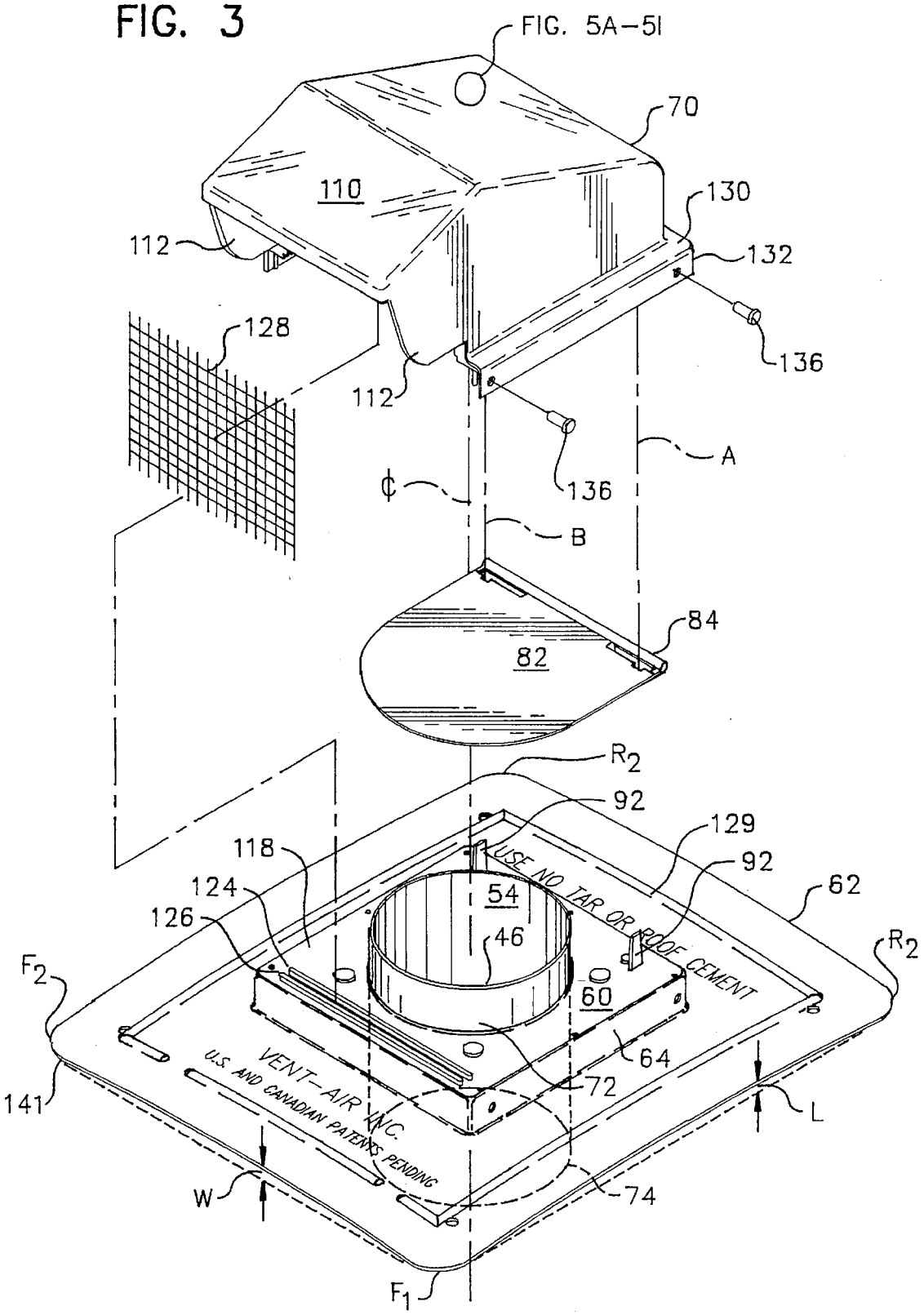
FIG. 3 is an exploded perspective view of the roof vent of the present invention, showing the molded one-piece base with integral tubular member, as well as a flapper valve cover means, a hood, and screen.

Turning now to FIG. 3, the exploded perspective view shows the construction of the exhaust ventilator 40 which utilizes the molded one-piece base with integral tubular member 42 as taught herein. Also seen in this FIG. 3 is the method of affixing the hood 70 to the base 62. The hood 70 has an outwardly extending shoulder 130 which connects to a downwardly extending shoulder 132. Locator pins 134 (see FIG. 2) may be optionally provided to position the hood 70 appropriately above outward face portion 60 of base 62. Fasteners 136 are provided to affix shoulder 132 of hood 70 to ring band portion 64 of base 62.

Figure 4:
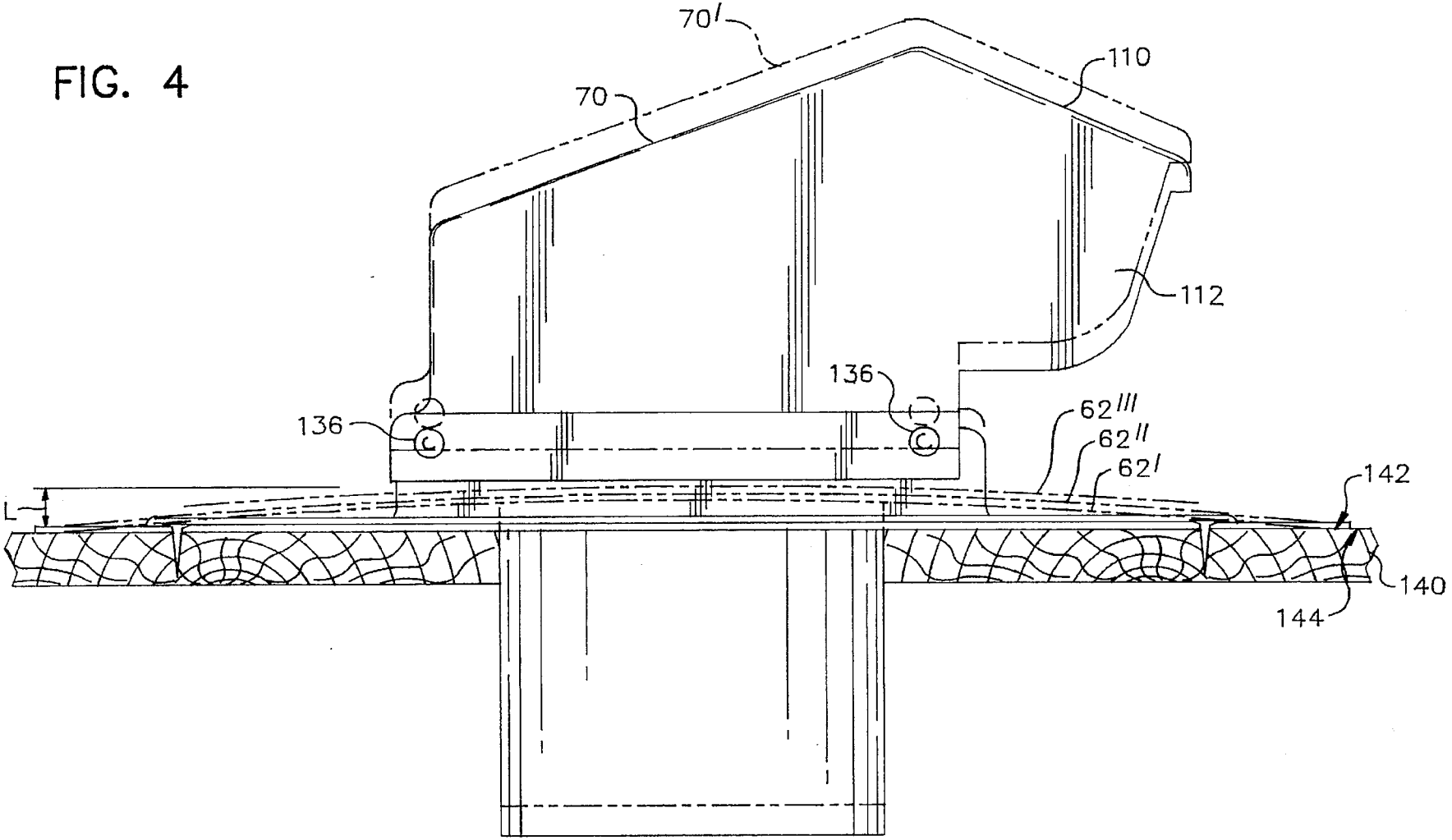
FIG. 4 is a side elevation view of the exhaust vent of the present invention, with only partial roof deck portion present so that the entire tubular member may be seen.
Figure 5A:
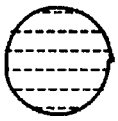
FIGS. 5A, 5B, 5C, 5D, 5E, 5F, 5G, 5H, and 5I represent alternate colors for the exhaust vent of the present invention.
Figure 5B:
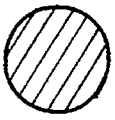
Figure 5C:
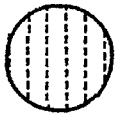
Figure 5D:
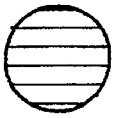
Figure 5E:
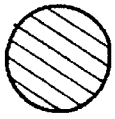
Figure 5F:
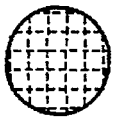
Figure 5G:
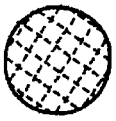
Figure 5H:
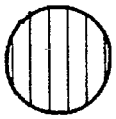
Figure 5I:
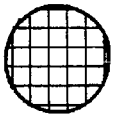

Attention is now directed to FIG. 4, wherein a side view of the exhaust vent 40 is provided. Base 62 is preferably provided, as manufactured, with a deformable concave shape, as indicated by lines 62', 62", and 62''', so that as the vent 40 is set on a roof deck 140, the base deforms from position 62''', tO 62", then to 62', and finally is positioned substantially flat or planar at 62, firmly against a deck (roof or wall) 140. This deformable concave shape is provided along the outer edge 141 of base 62 in both axes, i.e. from front corner $F_1$ to back corner $R_1$, or front corner $F_2$ to rear corner $R_2$ and from side to side (front corner to front corner, or from back corner to opposing back corner) so that there is a deformable vertical distance L with respect to the front to back axis, and a deformable vertical distance a W with respect to the side to side axis (see FIG. 3). This deformable concave shape allows the vent 40 to be depressed into the deck 140 so that the outer edge 141 of the base 62 is compressed against the deck 140, to provide a sealing edge between the bottom 142 of base 62 and the top 144 of deck 140. Preferably, L and W are about 0.25 inches or less, and more preferably, L and W are about 0.125 inches or less.

In FIG. 5, it can be appreciated that the vent can be advantageously manufactured in a corrosion resistant plastic such as high density polypropylene or ABS which can be pigmented to a desired color. FIG. 5A shows a gray or silver vent 40. FIG. 5B shows a brown vent 40; FIG. 5C shows a violet or purple vent 40; FIG. 5D shows a blue vent 40; FIG. 5E shows a green vent 40; FIG. 5F shows a yellow or gold vent 40; FIG. 5G shows an orange vent 40; FIG. 5H shows a red or pink vent 40; FIG. 5I shows a vent of another desired color such as black. The just described plastic and colors are used for both the hood and the base of the vent.

From the foregoing, it is seen that we have provided an exhaust vent having an integral tubular member and base made of one piece of plastic, thereby avoiding seams and providing high strength with minimum weight and cost. Injection molding can be used to form such a one piece molded base with integral tubular member for an exhaust vent. Therefore, it is to be appreciated that the one-piece base with integral tubular member for exhaust ventilator, as provided in the exhaust vent of the present invention, is an outstanding improvement in the state of the art of exhaust ventilator fabrication. The process of manufacture of the ventilator is relatively simple, and the resulting ventilator substantially reduces the labor and materials required for installation of exhaust ventilators when compared to prior two-piece ventilator construction.

It is thus clear from the heretofore provided description in conjunction with the drawing that the present exhaust ventilator invention, although simple, is a dramatic improvement in the state of the art in ventilators. It will be readily apparent to the reader that the present invention may be easily adapted to other embodiments incorporating the concepts taught herein and that the present figures are shown by way of example only and not in any way a limitation. Thus, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalences of the claims are therefore intended to be embraced therein.

We claim:

1. An exhaust ventilator, said ventilator adapted to provide a conduit for passage of exhaust gases through the roof or wall of a selected building structure while protecting said conduit against entry of water from the outdoors, said ventilator comprising:

a. a base member, and b. a continuous one-piece tubular member having a jointless through passageway with a top and a bottom, said tubular member extending through said base member and integrally formed therewith, so as to provide a downwardly extending interior flange and a upwardly extending exterior flange portion of said tubular member relative to said base member, wherein said interior flange is configured to be sufficiently long so as to extend downwardly into a selected building structure to said bottom of said tubular member; and c. a hood, said hood adapted to engage said base member, said hood sized to protect said exterior flange portion of said tubular member against entry of water from the outdoors.

2. The ventilator as set forth in claim 1, wherein said base member further comprises:

a. a peripheral portion;

b. an interior portion, said interior portion integrally formed with, adjacent to and inward from said peripheral portion;

c. a ring band portion, said ring band portion integrally formed with, affixed and substantially perpendicular to said interior portion of said base member;

d. an outward face portion, said outward face portion (i) substantially co-planar with said peripheral portion and with said interior portion, and (ii) integrally formed with, and affixed to said ring band portion.

3. The ventilator as set forth in claim 2, wherein said outward face portion is integrally formed in one-piece with said tubular member.

4. The ventilator as set forth in claim 1, wherein said base member and said tubular member are formed by injection molding.

5. The ventilator as set forth in claim 4, wherein said base member comprises plastic.

6. The ventilator as set forth in claim 2, further comprising a moisture barrier, said barrier located between said interior portion and said peripheral portion of said base member for at least a portion of the perimeter of said interior portion, said moisture barrier having a vertical dimension, and whereby said vertical dimension results in an upward gradient toward the periphery of said vent base member and against which water cannot flow by gravity.

7. The ventilator as set forth in claim 1 or claim 2, wherein said base member comprises front corners ($F_1$ and $F_2$), and back corners ($R_1$ and $R_2$), and wherein said base member is provided in a deformable concave shape between front corners ($F_1$ and $F_2$), and between back corners ($R_1$ and $R_2$), in a concave dimension W.

8. The ventilator as set forth in claim 7, wherein said concave shape is also provided between a right front corner ($F_1$) and a right rear corner ($R_1$), and between a left front corner ($F_2$) and a left rear corner ($R_2$), in a concave dimension L.

9. The apparatus as set forth in claim 1, wherein said base member comprises front corners ($F_1$ and $F_2$), and back corners ($R_1$ and $R_2$), and wherein said base member is provided in a deformable concave shape between front corners ($F_1$ and $F_2$), and between back corners ($R_1$ and $R_2$), in a concave dimension W, wherein said dimension W is about 0.25 inches or less.

10. An exhaust ventilator, said ventilator adapted to provide a conduit for passage of exhaust gases through the roof or wall of a building structure, said ventilator comprising a. a base member, and b. a continuous one-piece tubular member having a jointless through passageway, said tubular member having a top and a bottom and extending through said base member and sealed thereto, so as to provide an interior flange and an exterior flange portion of said tubular member relative to said base member, wherein said interior flange is configured to be sufficiently long so as to extend through a selected building roof or wall structure to said bottom of said tubular member; and c. a hood, said hood adapted to engage said base member to cover said exterior flange portion of said tubular member.

11. The ventilator as set forth in claim 10, wherein said tubular member is integrally formed with said base member.

12. The ventilator as set forth in claim 11, wherein said base member further comprises:

a. a peripheral portion;

b. an interior portion, said interior portion integrally formed with, adjacent to and inward from said peripheral portion;

c. a ring band portion, said ring band portion integrally formed with, affixed and substantially perpendicular to said interior portion of said base member;

d. an outward face portion, said outward face portion substantially co-planar with said peripheral portion and said interior portion, and integrally formed with, and affixed to said ring band portion.

13. The ventilator as set forth in claim 12, wherein said outward face portion of said base member is integrally formed with and connected directly to said tubular member.

14. The ventilator as set forth in claim 10 or claim 12, wherein said base member and said tubular member are formed by injection molding.

15. The ventilator as set forth in claim 10 or claim 12, wherein said base member comprises plastic.

16. The ventilator as set forth in claim 12, further comprising a moisture barrier, said barrier located between said interior portion and said peripheral portion of said base member for at least a portion of the circumference of said interior portion, said moisture barrier having a vertical dimension, and whereby said vertical dimension results in an upward gradient toward the periphery of said vent base member and against which water cannot flow by gravity.

17. The ventilator as set forth in claim 12, wherein said hood is adapted to directly fasten to and sit above said outward face portion, and said hood is adapted to be fastened to said ring band portion.

18. The ventilator as set forth in claim 17, further comprising a flapper valve portion, wherein said flapper valve is pivotally located within said hood and is displaceable from a closed position wherein said valve is urged by gravity against said upper end of said through passageway so as to substantially seal said upper end of said through passageway against inward migration of gases, to an open position, wherein said valve is urged to an open position by the pressure of fluid flow outward through said through passageway, so that said fluid may migrate outward through said through passageway.

19. The ventilator as set forth in claim 17, further comprising a screen portion, and wherein said hood further comprises screen retaining portions, and wherein said screen is secured between said screen retaining portions of said hood and said outward face portion of said base member.

20. The ventilator as set forth in claim 10 or claim 12, wherein said base member comprises front corners ($F_1$ and $F_2$), and back corners ($R_1$) and ($R_2$), and wherein said base member is provided in a deformable concave shape between front corners ($F_1$ and $F_2$), and between back corners ($R_1$ and $R_2$), in a concave dimension W.

21. The ventilator as set forth in claim 20, wherein said deformable concave shape in said base member is provided between a right front corner ($F_1$) and a right rear corner ($R_1$), and between a left front corner ($F_2$) and a left rear corner ($R_2$), in a concave dimension L.

22. The apparatus as set forth in claim 21 wherein said dimension W is about 0.125 inches or less.

23. The apparatus as set forth in claim 21, wherein said concave shape is also provided between a right front corner ($F_1$ ) and a right rear corner ($R_1$), and between a left front corner ($F_2$) and a left rear corner ($R_2$), in a concave dimension L wherein said dimension L is about 0.25 inches or less.

24. The apparatus as set forth in claim 23, wherein said dimension L is about 0.125 inches or less.

25. The apparatus as set forth in claim 10, wherein said base member comprises front corners ($F_1$ and $F_2$), and back corners ($R_1$ and $R_2$), and wherein said base member is provided in a deformable concave shape between front corners ($F_1$ and $F_2$), and between back corners ($R_1$ and $R_2$), in a concave dimension W, wherein said dimension W is about 0.25 inches or less.

26. The apparatus as set forth in claim 25, wherein said dimension W is about 0.125 inches or less.

27. The apparatus as set forth in claim 10, wherein a deformable concave shape in said base member is provided between a right front corner ($F_1$) and a right rear corner ($R_1$), and between a left front corner ($F_2$) and a left rear corner ($R_2$), in a concave dimension L wherein said dimension L is about 0.25 inches or less.

28. The apparatus as set forth in claim 27, wherein said dimension L is about 0.125 inches or less.

* * * * *